US005110641A

United States Patent [19]

Kean

[11] Patent Number: 5,110,641

[45] Date of Patent: May 5, 1992

[54] MELT-DISPERSIBLE PACKAGE FOR MELT-PROCESSIBLE POLYMERS

[75] Inventor: Norman B. Kean, Limavady, Northern Ireland

[73] Assignee: E. I. du Pont de Nemours and Company, Wilmington, Del.

[21] Appl. No.: 629,659

[22] Filed: Dec. 14, 1990

[51] Int. Cl.[5] ..... B65D 33/26

[52] U.S. Cl. ..... 428/35.5; 383/92; 206/447; 206/524.7

[58] Field of Search ..... 428/35.5; 383/92; 206/447, 460, 524.7

[56] References Cited

U.S. PATENT DOCUMENTS

| | | | |
|---|---|---|---|
| 2,617,775 | 11/1952 | Newberg et al. | 260/4 |
| 2,931,148 | 4/1960 | Smith | 206/524.7 |
| 2,955,708 | 10/1960 | Hausch | 206/524.7 |
| 3,137,864 | 6/1964 | Ostmann, Jr. | 2/243 |
| 3,424,616 | 1/1969 | Scheler | 128/284 |
| 3,649,399 | 3/1972 | Nakanishi | 156/93 |
| 4,110,500 | 8/1978 | Evans | 206/524.7 |
| 4,112,158 | 9/1978 | Creekmore | 206/447 |
| 4,190,156 | 2/1980 | Adam | 206/447 |
| 4,334,615 | 6/1982 | Butler et al. | 206/447 |
| 4,439,476 | 3/1984 | Guild | 428/96 |

FOREIGN PATENT DOCUMENTS

| | | |
|---|---|---|
| 1168404 | 10/1969 | United Kingdom . |
| 1168405 | 10/1969 | United Kingdom . |

*Primary Examiner*—James J. Seidleck
*Assistant Examiner*—Rena L. Dye
*Attorney, Agent, or Firm*—Craig H. Evans

[57] ABSTRACT

The subject invention provides a package for a heat seal sensitive polymer comprising a thermoplastic bag sealed at one end with a thermoplastic polymeric thread, both the thermoplastic bag material and the thermoplastic thread material having a melt temperature at or below the processing temperature of the heat seal sensitive polymer.

10 Claims, No Drawings

MELT-DISPERSIBLE PACKAGE FOR MELT-PROCESSIBLE POLYMERS

BACKGROUND

Many polymer compositions are packaged in flexible packages such as paper and plastic bags. The bags are generally sealed at one end, placed under the exit orifice of a polymer manufacturing line, filled with polymer and sealed. Sealing means used include thread (e.g., cotton), various adhesives and, in the case of plastic bags, heat sealing.

In the case where the polymer compositions are to be melt processed or masticated at high temperature, it has been desirable to package the melt processible polymer in a bag made from a plastic that, when processed along with the polymer composition, does not adversely affect the desired properties of the polymer composition. The advantages of such a combination are that the bag and polymer contents can be added to the processor together without having to open and empty the bag; and, of course, there are no empty bags to dispose of. The sealing means for such plastic bags have varied, the most common being heat sealing. Heat sealing is, however, not useful in situations where the polymer composition to be packaged is heat-sensitive, or where the polymer composition to be packaged contains powdery fines, or talc (hereinafter a heat seal sensitive polymer). For example, neoprene, a well-known homopolymer of chloroprene, or copolymer of chloroprene with other unsaturated monomers, is sold as unvulcanized chips that are quite tacky. To reduce the tackiness for ease of handling, the surface of chips is treated with the talc. The talc, however, interferes with heat-sealing processes. One way to overcome this problem is disclosed in U.S. Pat. No. 4,190,156 (Adam) whereby a thermoplastic bag is closed using synthetic polymer thread. The bag material and thread are said to be readily dispersible in the neoprene at the blending temperature to give homogeneous dispersion. The thread used is made from polyvinyl alcohol having a melt temperature of 213° (well above the processing/compounding temperature of neoprene, i.e, 100°-120° C.) and is said to have sufficiently low strength so as to break and disperse readily in the polymer at the blending stage. However, in some applications, dispersed particulate polymer such as polyvinyl alcohol is undesirable in that it interferes with the processing of the polymer.

Therefore, there remains a need for a bag/seal packaging system, for heat-seal sensitive polymers, where the bag/seal can be introduced into the polymer melt processor unopened, and where the bag/seal composition will not interfere with the processing of the polymer.

SUMMARY

The subject invention provides a package for a heat seal sensitive polymer comprising a thermoplastic bag sealed at one end with a thermoplastic polymeric thread, both the thermoplastic bag material and the thermoplastic thread material having a melt temperature at or below the processing temperature of the heat seal sensitive polymer.

The subject invention also provides an article comprising a package containing a heat seal sensitive polymer wherein the package comprises a thermoplastic bag sealed at both ends, at least one seal being with a thermoplastic polymeric thread, both the thermoplastic bag material and the thermoplastic thread material having a melt temperature at or below the processing temperature of the heat seal sensitive polymer.

DETAILED DESCRIPTION

The heat seal sensitive polymers contemplated for packaging using the subject invention include those that are inherently sensitive, because of their melt temperatures, to the temperatures created in the heat sealing environment, as well as polymers that by virtue of their manufacturing process have indigenous (e.g., polytetrafluoroethylene fine powder resins) or exogenous (e.g., talc added to unvulcanized neoprene, chlorinated polyethylene or chlorosulfonated polyethylene) fines associated therewith. Heat seal sensitivity is imparted by the presence of the fines due to the possibility of heat combustion from the heat sealing process or due to the possibility of fines themselves lodging between the surfaces to be heat sealed, disrupting the heat seal.

The bag material is a thermoplastic polymer that melts at or below the processing temperature of the polymer to be packaged. If the bag material is a thermoplastic polymer that has no absolute melting point, the Vicat softening point (ASTM 1525) may be used as a reference point. Examples of such bag material include low-density polyethylene (m.p. 70° to 110° C.) and ethylene/vinyl acetate copolymer, as well as polyethylene blended with an ethylene/vinyl acetate copolymer, the ratio of the blend depending upon the processing temperature of the polymer to be packaged. Such blends generally have Vicat softening points of 60°-120° C., preferably 70°-110° C. in the case where, e.g., neoprene is the polymer to be packaged. Other bag materials having similar Vicat softening points/melting points, e.g. butadiene-modified styrene polymers can, of course, be used without departing from the spirit of the subject invention. The useful thickness of the bag material will be apparent to those skilled in the art, generally in the range of 100-200 microns, preferably 150-175 microns; thinner gauge bags will lack stiffness and strength, while thicker gauge bags will result in excessive amounts of bag material ultimately being melt blended with the packaged polymer. The useful quantitative amount of bag material is also limited by the amount of bag material ultimately desired to be melt blended with the packaged polymer; generally amounts from 0.1 to 1.0% based on the weight of the package polymer are acceptable, the practical upper limit being controlled by the amount which begins to adversely affect the desirable properties of the packaged polymer.

The thermoplastic thread material is also a thermoplastic polymer that melts at or below the processing temperature of the polymer to be packaged, preferably 60°-120° C. in the case where, e.g., neoprene is the polymer to be packaged. The thread may be either monofilament or multifilament. The gauge and type of thread material must be such as to not adversely affect the desired properties of the packaged polymer. The gauge of the thread can be from 0.1 g/m to 1.0 g/m, the lower the melting point of the thread material, the less structural integrity, and hence, the greater the gauge required. A preferred example of such thread is a copolyamide thread with a melting point of about 85° C. available from Grilon S.A. as K-85 copolyamide thread, the copolyamide being a 6/66/12 type having a random distribution of monomer units derived from epsilon-caprolactam or epsilon-aminocaproic acid or both, 10-50% by weight of monomer units derived from hexamethylene diamine adipate and 5 to 70% by weight of monomer units derived from laurolactam or caprolactam; the monomer derived from laurolactam or caprolactam; the monomer ratio being selected in view of the melt temperature required as discussed in more detail in British Pat. Nos. 1,168,404 and 1,168,405. Other useful thread materials include polymers and copolymers of ethylene, propylene, vinyl chloride, vinylidene chloride, vinyl acetate, acrylonitrile, acrylates, and methacrylates, etc., having melting points below the processing temperature of the polymer to be packaged. Sealing of the bag with polymeric thread is achieved using commercial bag-stitching equipment. Of course, one end of the bag can be sealed in any conventional manner (e.g., heat seal) before the bag is filled with the polymer to be packaged. Surprisingly, this relatively low melting polymeric thread does not break, or lose its dimensional stability or strength when run through such commercial stitching equipment.

In the case where the packaged polymer is neoprene, chlorinated polyethylene or chlorosulfonated polyethylene, additives used during processing can include fillers, stabilizers, pigments, vulcanizing/curing agents, accelerators and inhibitors. The polymers are vulcanized/cured according to normal techniques to give compositions having good mechanical properties, particularly when used in conjunction with reinforcing fillers, such as carbon black, hard clay, precipitated silica, fine talc and calcium silicate. The compositions can be in the form of shaped articles such as hoses, cable jackets, and transmission belts.

EXAMPLES

EXAMPLE 1

One metric tonne of neoprene (a mercaptan-modified, talc coated, polychloroprene having a Mooney viscosity of about 38) was packaged in block bottom sacks 750×530 ×140 mm, made from 0.175 mm thick polyethylene having a Vicat softening point of 99° C. The sacks were closed by sewing with an 830 decitex copolyamide thread having a melting point of 85° C. (Grilon K-85). Forty filled sacks, each containing 25 kg of neoprene chips, were stacked in a regular array to form a one-tonne pallet.

A sample of this material was tested as follows. To a Brabender Plastograph chamber at a 87° C. were added 50 g of the neoprene chips and 20 g of SRF carbon black, together with 0.34 g of the polyethylene sack material and 0.6 cm length of the copolyamide thread. These quantities were chosen to be in proportion to those found in the 25 kg package. The mixture was blended in the Brabender Plastograph for 6 minutes at 63 r.p.m., resulting in a final compound temperature of 111° C. The compound was then milled to a thin sheet using a two roll mill with 0.7 mm nip spacing. The test sample appeared identical to a control sample, indicating complete dispersion of the polyethylene and the thread in the compound. Extrusions prepared using the test compound were also identical to control extrusions, and showed no signs of undispersed matter.

I claim:

1. An article comprising a package containing a heat seal sensitive polymer wherein the package comprises a thermoplastic bag sealed at both ends, at least one seal being with a thermoplastic polymeric thread, both the thermoplastic bag material and the thermoplastic thread material having a melt temperature at or below the processing temperature of the heat seal sensitive polymer.

2. The article of claim 1 wherein the heat seal sensitive polymer is selected from neoprene, chlorinated polyethylene, or chlorosulfonated polyethylene.

3. The article of claim 1 or 2 wherein the thermoplastic bag comprises polyethylene.

4. The article of claim 1 or 2 wherein the thermoplastic bag comprises a polyethylene and ethylene/vinyl acetate copolymer blend.

5. The article of claim 3 wherein the polyethylene has a Vicat softening point of 70° to 100° C.

6. The article of claim 4 wherein the blend has a Vicat softening point of 60° to 120° C.

7. The article of claims 1, 2, 3, or 4 wherein the thermoplastic thread material is a copolyamide thread material.

8. The article of claim 7 wherein the copolyamide thread material has melting point of 60°-120° C.

9. The article of claims 1, 2, 3, or 4 wherein the thread material is selected from the group consisting of polymers and copolymers of ethylene, propylene, vinyl chloride, vinylidene chloride, vinyl acetate, acrylonitrile, acrylates or methacrylates having melting points/-Vicat softening points of 60°-120° C.

10. The article of claim 2 wherein the thermoplastic bag comprises polyethylene having a Vicat softening point of 70° to 110° C. and the thread material is a copolyamide thread material having a melting point of 60°-120° C.

* * * * *